US008012426B2

(12) United States Patent
Bonapace

(10) Patent No.: US 8,012,426 B2
(45) Date of Patent: Sep. 6, 2011

(54) SECURE KNIFE LOCKER AND SANITIZING SYSTEM

(76) Inventor: Mario J. Bonapace, Spring Valley, CA (US)

( * ) Notice: Subject to any disclaimer, the term of this patent is extended or adjusted under 35 U.S.C. 154(b) by 102 days.

(21) Appl. No.: 12/421,491

(22) Filed: Apr. 9, 2009

(65) Prior Publication Data

US 2009/0255133 A1 Oct. 15, 2009

Related U.S. Application Data

(60) Provisional application No. 61/044,204, filed on Apr. 11, 2008.

(51) Int. Cl.

| | |
|---|---|
| ***A61L 2/00*** | (2006.01) |
| ***G01N 23/00*** | (2006.01) |
| ***A47G 29/00*** | (2006.01) |
| ***E05B 73/00*** | (2006.01) |

(52) U.S. Cl. ..... 422/300; 250/455.11; 211/70.7; 211/4

(58) Field of Classification Search ..... 422/300; 250/455.11; 211/70.7, 4

See application file for complete search history.

(56) References Cited

U.S. PATENT DOCUMENTS

| | | | | |
|---|---|---|---|---|
| 4,182,530 | A * | 1/1980 | Hodge | 294/68.26 |
| 5,245,756 | A * | 9/1993 | Howell et al. | 30/298.4 |
| 6,591,765 | B2 * | 7/2003 | Braddock | 109/52 |

FOREIGN PATENT DOCUMENTS

| | | | |
|---|---|---|---|
| CA | 2355925 A1 | * | 2/2002 |
| GB | 2258806 A | * | 2/1993 |
| JP | 2001333963 A | * | 12/2001 |

OTHER PUBLICATIONS

English Translation of Japanese Patent Document No. JP 2001333963A provided by the industrial property digital library: Murakami, Sterilization Chamber for Cooking Appliance, Hairdressing Tools, has Germicidal Lamp Irradiating the Inner side of Housing, Dec. 4, 2001.*

* cited by examiner

*Primary Examiner* — Kevin Joyner
(74) *Attorney, Agent, or Firm* — Richard D. Clarke

(57) ABSTRACT

The present application is directed to a knife locker and sanitizing system consisting of a unique combination of one or more knife storage lockers that can individually be locked with a pad lock by the person using that set of knives. The incorporation of a locking bar that is attached to the knife locker by the means of a locking fixture and having a separate padlock facilitates a means where by a knife maintenance employee can open all the locker doors at one time to service the knives. Adjacent to the knife lockers will be located a sanitizing chamber where the knife blades and handles along with other food processing implements can be immersed in a sanitizing liquid. An alternate embodiment of the sanitizing chamber will incorporate ultraviolet lights on either side of the unit for the sanitizing process, enabling the ultraviolet light to not only disinfect the implement blades, but also the handles. The system will be mounted on a wall by the means of a system mounting bar with top and bottom rails attached to the lockers and the sanitizing chamber, thereby enabling the scaling up or down of the number of units as required.

7 Claims, 7 Drawing Sheets

SECURE KNIFE LOCKER AND SANITIZING SYSTEM

FIELD OF THE INVENTION

This application relates to holders and methods of sanitizing knives used for but not limited to commercial applications, such as restaurants, butcher shops, meat packing plants and the like. More specifically this patent deals with individuals keeping their knives separate from those of other individuals and the unique procedure of properly sanitizing the knife blade and handle along with other food processing implements.

BACKGROUND OF THE INVENTION

It is often highly desirable to provide a plurality of items of cutlery and food preparation implements such as knives of various sizes and blade configurations, spatulas, grill scrapers and hamburger turners which are supported in a readily accessible manner to permit convenient selection of a specific implements as required for a particular food preparation operation. Such an assortment of items are desirable in the kitchen and particularly in installations such as meat markets, butcher shops, restaurants and the like wherein continuous cutting and preparing operations take place. In the butcher shop, in particular, where meat is being continuously prepared for consumption, a wide variety of cutlery is generally provided such as trimming and slicing knives. As can be appreciated, it is also highly desirable that those knives, which are in constant use, be kept in a well sharpened and clean condition in order to facilitate efficient and sanitary cutting operations.

In commercial applications where one or more individuals are using knives, they like to keep their knives separate. Too often, the knives are misused, dulled or left with food products on them and then switched with someone else's knives. This produces a lot of contention among employees. The care and cleanliness of implements in food processing locations as well as restaurants is too often very poor.

Knife sharpening service is common in the food handling business where the knives are provided and periodically sharpened or replaced. With this service, an individual must have access to all the knives to pick up the dull knives and replace them with sharp ones. This usually means that the individual who keeps their knives clean and sharp has a difficult time keeping their knives separate, especially if the business is running more than one shift.

Numerous innovations for knife holders have been provided in the prior art that are described as follows. Even though these innovations may be suitable for the specific individual purposes to which they address, they differ from the present application as hereinafter contrasted. The following is a summary of those prior art patents most relevant to the knife locker and sanitization system, as well as a description outlining the difference between the features of the present application and those of the prior art.

U.S. Pat. No. 4,492,028 of John Bourgein describes a wall mounted knife holder which is operatively disposed on a vertical wall and which has an operative position generally parallel to the wall to which it is secured and an operative position in which it is tilted away from the wall whereby in its tilted position cutlery can be withdrawn from the holder without engaging overhead cabinetry.

This patent describes a wall mounted knife holder but does not offer the opportunity of being able to lock separate compartments for the knives while still being able to unlock all the compartments at one time. It does not deal with the sanitizing capability of the knife locker and sanitizing system in any way.

U.S. Pat. No. 5,245,756 of Robin S. Howell et al. tells of a lockable knife and block assembly having a knife block with a plurality of slots for housing a plurality of knife blades. Each knife blade is provided with a notch for engaging a spring-loaded locking and latching means located at the top and front of each slot. A spring-loaded biasing means is positioned at the bottom and front of each slot to bias a blade entering a respective slot toward the spring-loaded latching means. A push button release mechanism is attached to each locking and latching means for disengaging a knife blade latched thereto.

This patent describes a lockable knife container that is opened by the means of a push button release mechanism. It does not work with a conventional pad lock to be opened with a key. It is just a container for a single set of knives and does not have the sanitizing capability.

U.S. Pat. No. 5,490,607 of Wen-Hsiung Hsieh et al. discloses a knife holder that includes a board having a rib laterally formed on the front surface and having two cavities formed in the rear surface for receiving magnets which may attach the knife holder to a metal surface. A case includes a rear panel and two flanges extended rearward from the rear panel for engaging with the front surface of the board. The rear panel and the rib form a slot for receiving and for protecting the knife blade. The knife blades may be completely received and protected between the board and the case.

This patent discloses a conventional knife holder with magnets to hold it in place. It has been designed for home use and not to be used in a commercial application.

U.S. Pat. No. 6,079,108 of Chin-Chih Lin describes a knife holder that has a hollow casing, a positioning plate disposed in the hollow casing, and a base plate disposed on a bottom of the hollow casing. The base plate has a periphery recess. The positioning plate has a center hole, an oblong aperture, and a plurality of slot apertures. An oblong hole is formed on a top portion of the hollow casing. A plurality of slot apertures are formed on the top portion of the hollow casing. A post extends downward from the top portion of the hollow casing. The post has a threaded end inserted in the center hole and fastened by a nut. The hollow casing has a periphery flange engaging with the periphery recess.

This patent describes a kitchen knife holder made from a variety of scented thermoplastics with a fan and an electro thermal device to prevent the interior of the holder from being moist. It does not have the individual locker compartments or the sanitizing capability.

U.S. Pat. No. 6,643,949 of Lin Wen Yen tells of a heat-drying knife holder that includes a heat-generating member installed in a knife groove base of a knife holder consisting of a front shell and a rear shell and an upper cover having a plurality of insert holes for knives to insert. A knife groove base with open knife grooves are fitted in the shell body and has a pull-push water-collecting tray provided at the bottom. A fundamental base is positioned under the shell body and is collapsible for convenience of being placed on a flat surface or on a table. The heat-generating member is installed in the knife groove base and a cement resistor or an electric-heating tube or an electric-heating rod can be used as the heat-generating member to generate heat energy for heat-drying the knife blades inserted in the knife grooves.

This patent describes a heat drying knife holder for a single set of knives, but does not have the unique multiple capabilities of the knife locker and sanitizing system.

Patent Publication No. 2003/0066971 of Lin Wen Yen discloses a disinfecting device of a knife holder, which discloses the use of an ultraviolet disinfecting lamp secured in a knife groove base of a knife holder consisting of a front shell and a rear shell and an upper cover. The upper cover has a plurality of insert holes provided spaced apart for knives to insert therein. A knife groove base having an open knife groove inside is fitted in the shell body and has a pull-push water-collecting tray fitted at a bottom side. Then, a fundamental base is positioned under the shell body and is collapsible for facilitating to be placed on a surface or on a table. An ultraviolet lamp is fixedly installed at a lower portion inside the knife groove base and covered around by a protective shade to prevent water from seeping in. The ultraviolet light of the ultraviolet lamp shines into the knife grooves and disinfects the knife blades therein.

This patent describes the use of an ultraviolet within a knife holder for disinfecting knives therein, but does not have the unique multiple capabilities of the knife locker and sanitizing system, even when the present invention is combined with an ultraviolet light for the purpose of sanitization of knives within the system.

None of these previous efforts, however, provides the benefits attendant with the present application. The present knife locker and sanitizing system achieves its intended purposes, objects and advantages over the prior art devices through a new, useful and unobvious combination of method steps and component elements, with the use of a minimum number of functioning parts, at a reasonable cost to manufacture, and by employing readily available materials.

In this respect, before explaining at least one embodiment of the knife locker and sanitizing system in detail it is to be understood that the design is not limited in its application to the details of construction and to the arrangement, of the components set forth in the following description or illustrated in the drawings. The knife locker and sanitizing system is capable of other embodiments and of being practiced and carried out in various ways.

In addition, it is to be understood that the phraseology and terminology employed herein are for the purpose of description and should not be regarded as limiting. As such, those skilled in the art will appreciate that the conception, upon which this disclosure is based, may readily be utilized as a basis for designing of other structures, methods and systems for carrying out the several purposes of the present design. It is important, therefore, that the claims be regarded as including such equivalent construction insofar as they do not depart from the spirit and scope of the present application.

SUMMARY OF THE INVENTION

The principal advantage of the knife locker and sanitizing system is the care and maintenance of knives.

Another advantage of the knife locker and sanitizing system is the capability of keeping each individuals set of knives in a separate locker that can be locked with a pad lock.

Another advantage is to develop a knife locker that will hold one or more knives of varying sizes.

Another advantage is to create a set of one or more lockers attached together that all can be opened with a single pad lock by an individual employed by a knife maintenance service.

Another advantage of the knife locker and sanitizing system is incorporation of a sanitizing chamber where the knife blades and handles can be immersed and agitated repeatedly up and down in a sanitizing solution to enhance the sanitizing operation.

Another advantage of the knife locker and sanitizing system is that the knife lockers and sanitizing chamber can be mounted on a single mounting plate.

Another advantage of the knife locker and sanitizing system is that the sanitizing chamber can easily be removed for cleaning or replacing sanitizing liquids.

Another advantage of the knife locker and sanitizing system is that the knife lockers and sanitizing chamber can be mounted on separate mounting plates at different locations.

Another advantage is that the sanitizing chamber can use varying methods of sanitizing the knives including heat or ultra violet light.

A further advantage of the knife locker and sanitizing system is that the storage and maintenance of knives can be located in one location.

And still another advantage of the knife locker and sanitizing system is to add a new and unique system of food preparation implement care and maintenance to the area of food handling.

These together with other objects of the knife locker and sanitizing system, along with the various features of novelty, which characterize the design, are pointed out with particularity in the claims annexed to and forming a part of this disclosure. For a better understanding of the knife locker and sanitizing system, its operating advantages and the specific objects attained by its uses, reference should be made to the accompanying drawings and descriptive matter in which there are illustrated preferred and alternate embodiments of the application.

The knife locker and sanitizing system consists of a unique combination of one or more knife storage lockers that can individually be locked with a pad lock by the person using that set of knives. The knife lockers, the knives and the locker locks will be sequentially numbered for each individual using the knives. The incorporation of a locking bar that is attached to the knife locker by the means of a locking fixture and having a separate padlock facilitates a means whereby a knife maintenance employee can open all the locker doors at one time to service the knives. Adjacent to the knife lockers will be located a sanitizing chamber where the knife blades and handles and other implements can be immersed in a sanitizing liquid. Implements such as spatulas, grill scrapers and hamburger turners to name just a few items can be inserted into the sanitizing chamber and moved up and down repeatedly to enhance the sanitizing operation.

An alternate embodiment of the sanitizing chamber will incorporate ultra violet lights on either side of the unit for the sanitizing process. A cover lid will have to be added to the top to protect the eyes of those using the sanitizing chamber with the ultra violet lights. The cover lid will automatically turn on and off the ultra violet lights when it is opened and closed. The system will be mounted on a wall by the means of a system-mounting bar with top and bottom rails attached to the lockers and the sanitizing chamber. The system could also be mounted on a standard shelf. The sanitizing chamber can easily be slid on and off for easy cleaning when necessary. The knife locker and sanitizing system can be used together or separately as required.

With respect to the above description then, it is to be realized that the optimum dimensional relationships for the parts of the knife locker and sanitizing system, to include variations in size, materials, shape, form, function and manner of operation, assembly and use, are deemed readily apparent and obvious to one skilled in the art. All equivalent relationships to those illustrated in the drawings and described in the specification intend to be encompassed by the present application. Therefore, the foregoing is considered as illustrative only of the principles of the knife locker and sanitizing system. Further, since numerous modifications and changes will readily occur to those skilled in the art, it is not desired to limit the design to the exact construction and operation shown and described, and accordingly, all suitable modifications and equivalents may be resorted to, falling within the scope of this application.

BRIEF DESCRIPTION OF THE DRAWINGS

The accompanying drawings, which are incorporated in and form a part of this specification, illustrate embodiments of this application and together with the description, serve to explain the principles of the knife locker and sanitizing system.

DETAILED DESCRIPTION OF THE PREFERRED EMBODIMENTS

Figure 1:
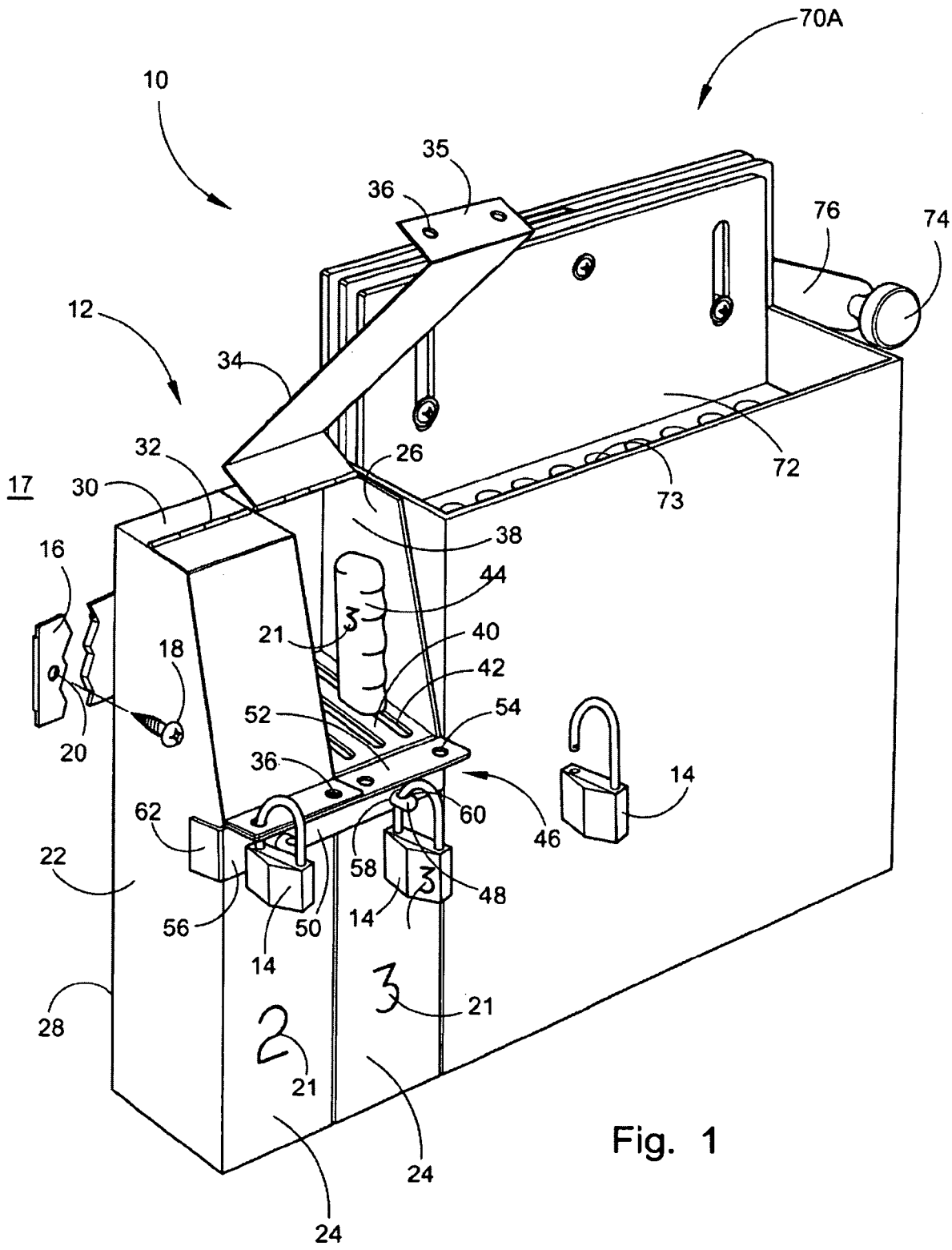
FIG. 1 depicts a perspective view of the knife locker and sanitizing system with one of the knife lockers closed and locked and the other open, with the pad lock removed.

For a fuller understanding of the nature and objects of this application, reference should be had to the following detailed description taken in conjunction with the accompanying drawings. FIG. 1 depicts a perspective view of the knife locker and sanitizing system 10 with one of the knife lockers 12 closed and locked with a pad lock 14 and the other open, with the pad lock 14 removed. One or more knife lockers 12 can be mounted to the system mounting bar 16, which is attached to the wall 17 by the means of a mounting screw 18 through the system mounting bar mounting orifice 20. The knife lockers 12, locks 14 and knives 44 will be given sequential numbers 21 to identify the individual to which they belong. The knife locker 12 is composed of a left side panel 22, a front panel 24, a right side panel 26 and a back panel 28. The top section 30 has a hinge 32 attached to the locking door panel 34 incorporating the locking flange 35 with locking orifices 36. The locker internal compartment 38 has a shelf 40 with a plurality of knife slots 42. A conventional knife 44 is illustrated in one of the knife slots 42.

A door locking bar 46 is removably attached to the lockers 12 by the means of locking fixtures 48 in the front panel 24, with the pad lock 14 attached. The door locking bar 46 consists of an angle plate 50 with the top section 52 having locking orifices 54 to match the locking orifices 36 in the locking flange 35 of the locking door panel 34. The lower section 56 of the angel plate 50 has orifices 58 to engage with the locking fixtures 48 in the front panel 24, having an orifice 60 to engage padlock 14 when the door locking bar 46 is in the locked down position. End tabs 62 at each end of the door locking bar 46 are angled back to support the combined knife lockers 12. The length of the door locking bars 46 will be governed by the quantity and the width of knife lockers 12 used in the knife locker and sanitizing system 10. It must be noted that the knife lockers 12 illustrated are the same size, but varying sizes and numbers of knife lockers 12 can be in combination within the knife locker and sanitizing system 10 and will remain within the scope of this application.

The sanitizing chamber 70A is shown adjacent to the knife lockers 12 and attached to the same system mounting bar 16. The sanitizing chamber 70A will have an implement rack 72 that moves up and down by the means of a hand knob 74 on a lever arm 76. The implement rack 72 is shown in the up position revealing the implement slots 73.

Figure 2:
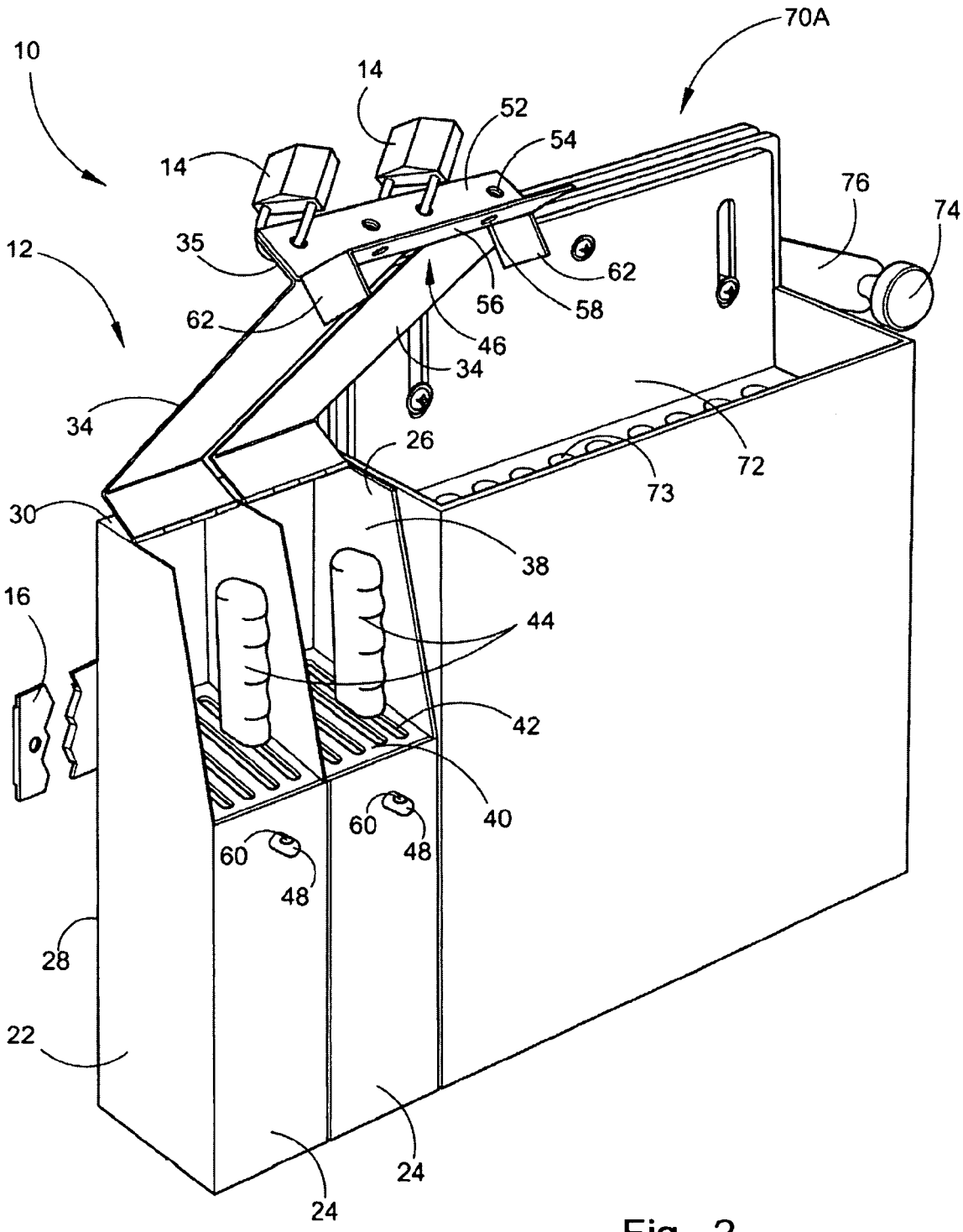
FIG. 2 depicts a perspective view of the knife locker and sanitizing system with both knife lockers open, with the doors held together by the means of the knife door-locking bar.

FIG. 2 depicts a perspective view of the knife locker and sanitizing system 10, with both knife lockers 12 open, having the doors held together by the means of the knife door locking bar 46. Both the locking door panels 34 are held together by the means of the two pad locks 14 that remain attached when a single pad lock 14 in the locking fixture 48 is disengaged and locking door panels are opened together. There may or may not be a locking fixture 48 in each knife locker 12. Only one lock is required to lock the door locking bar 46 in position on the front panel 24. The same procedure will work no matter how many knife lockers 12 are used on the knife locker and sanitizing system 10.

Figure 3:
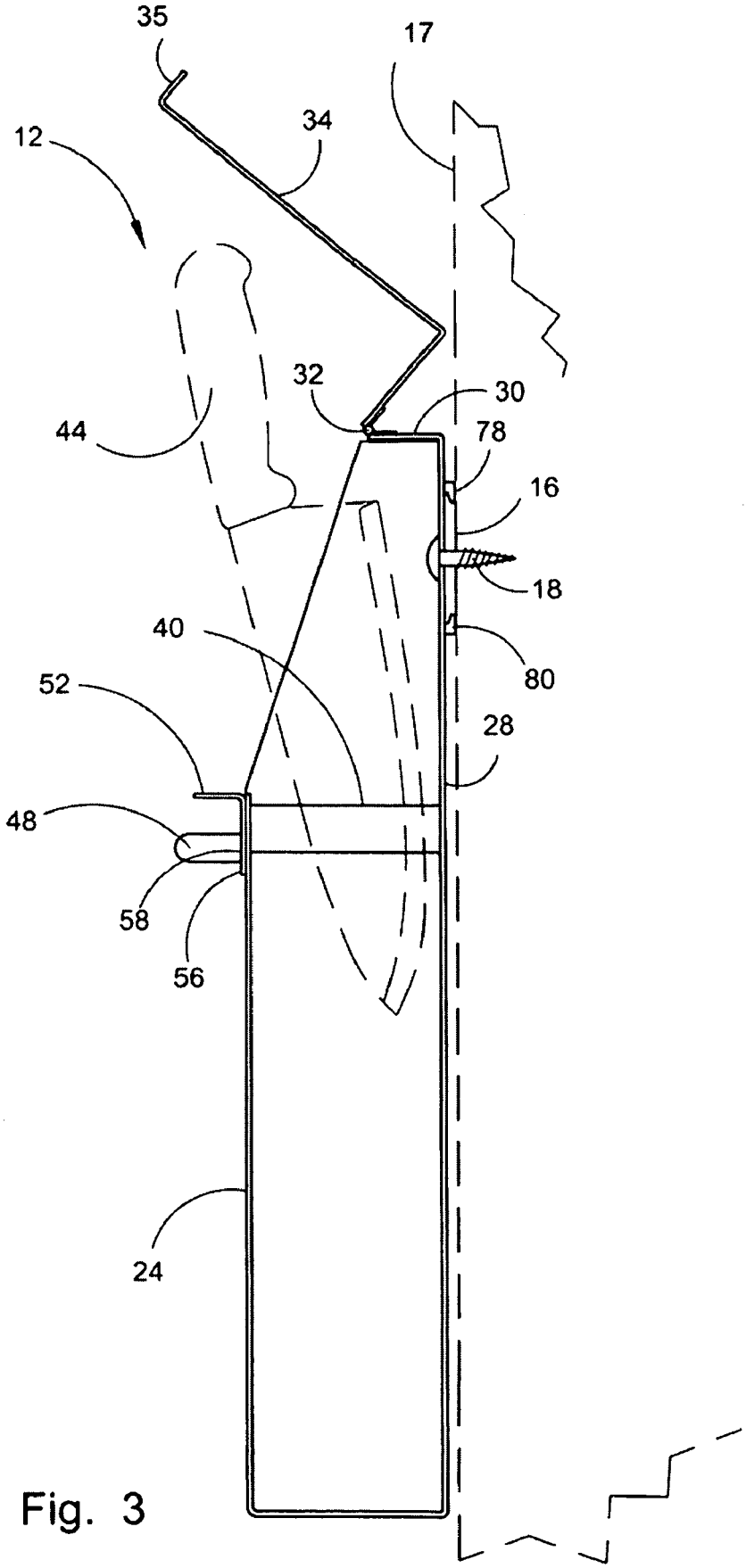
FIG. 3 depicts a side section view of a knife locker illustrating the insertion of a single knife and the method of mounting on a wall.

FIG. 3 depicts a side section view of a knife locker 12 illustrating the insertion of a conventional knife 44. This view clarifies the operation of the system mounting bar 16 attached to the wall 17 by the means of the mounting screw 18 and held in position by the means of an upper mounting track 78 and a lower mounting track 80 that are attached to the back panel 28. The system could also be mounted on a standard shelf.

Figure 4:
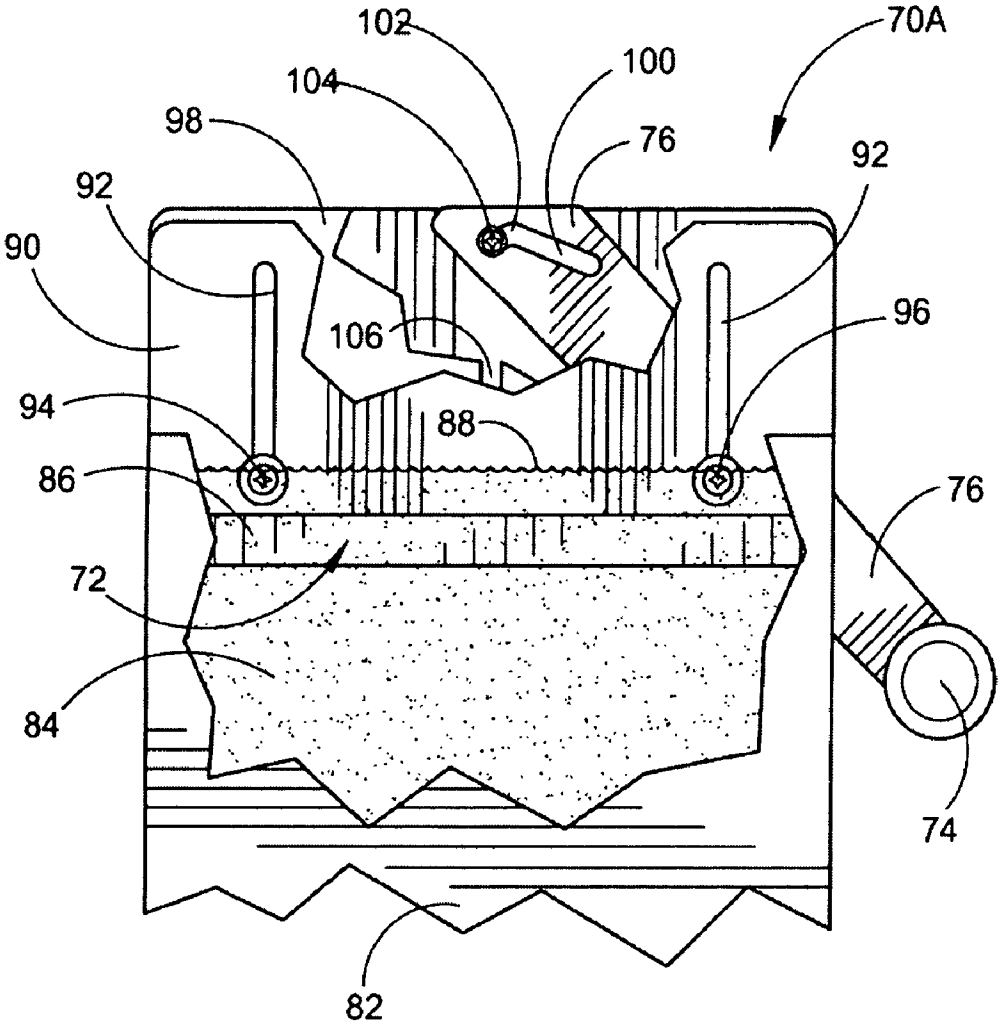
FIG. 4 depicts a front view of the sanitizing chamber with several surfaces cut away illustrating the knife rack in the up position.

FIG. 4 depicts a front view of the sanitizing chamber 70A with several surfaces cut away illustrating implement rack 72 in the up position. The sanitizing chamber front wall 82 has been cut away to reveal the sanitizing liquid 84 with the base plate 86 of the implement rack 72 just below the sanitizing liquid surface 88. The implement rack back plate 90 of the implement rack 72 has two primary guide slots 92 with primary guide pins 94 and 96 controlling the up and down movement of the implement rack 72. The primary guide pins 94 and 96 are attached to the sanitizing chamber back wall 98. The sanitizing chamber back wall 98 has been cut away to reveal the upper section of the lever arm 76 incorporating a secondary guide slot 100 with a dogleg 102 as a unique means to lock the implement rack 72 in the upper position. A secondary guide pin 104 translates within the secondary guide slot 100 along with moving up and down within a third guide slot 106 while being attached to the implement rack back plate 90 of the implement rack 72. The primary guide pin 96 works as a pivot where it is additionally attached to the lever arm 76 for moving the implement rack 72 from the upper position to the lower position. When the implement rack 72 is in the lower position, the conventional knife 44 blade and handle along with other food processing implements will be fully immersed in the sanitizing liquid 84. Repeatedly moving the implement rack 72 up and down, thereby agitating the implements, will enhance the sanitizing operation.

Figure 5:
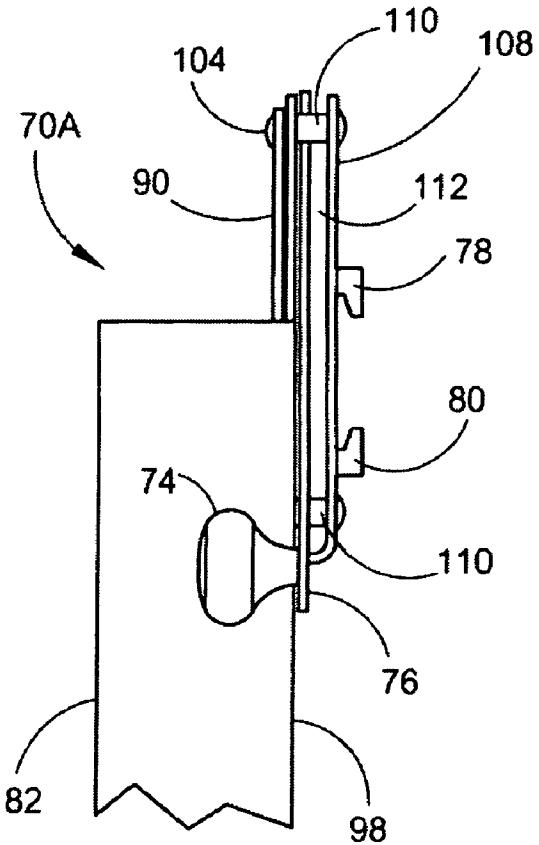
FIG. 5 depicts a side view of the sanitizing chamber illustrating the knife rack in the up position.

FIG. 5 depicts a side view of the sanitizing chamber 70A illustrating implement rack back plate 90 of the implement rack 72 in the up position. A rear mounting plate 108 is attached to the sanitizing chamber back wall 98 by the means of four rear mounting plate standoffs 110 providing a cavity 112 where the lever arm 76 has clearance to translate for the up and down movement of the implement rack 72. The upper mounting track 78 and the lower mounting track 80 are attached to the rear mounting plate 108 providing a means to slide the sanitizing chamber 70A off the system mounting bar 16 for the purpose of cleaning.

Figure 6:
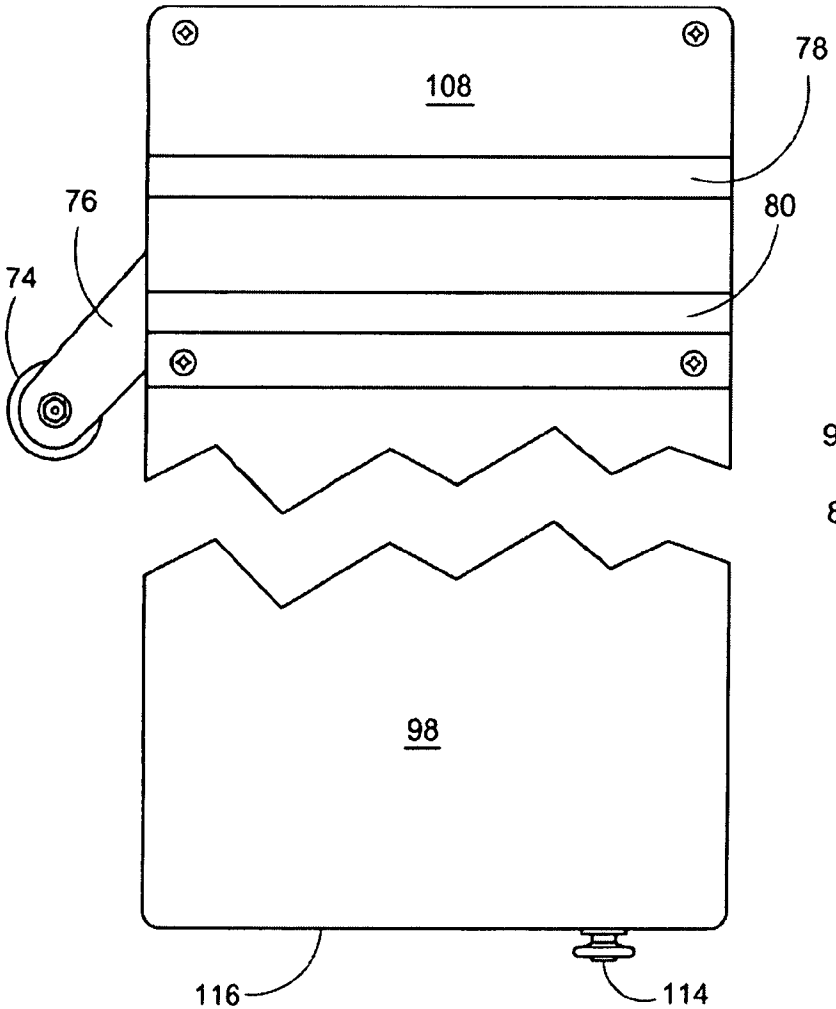
FIG. 6 depicts a rear view of the sanitizing chamber illustrating the rear mounting plate and mounting tracks.

FIG. 6 depicts a rear view of the sanitizing chamber 70A illustrating the upper mounting track 78 and the lower mounting track 80 attached to the rear mounting plate 108. A drain valve 114 is located on the sanitizing chamber bottom surface 116 of the sanitizing chamber 70A for removing the sanitizing liquid 84 while the sanitizing chamber is still attached to the system mounting bar 16.

Figure 7:
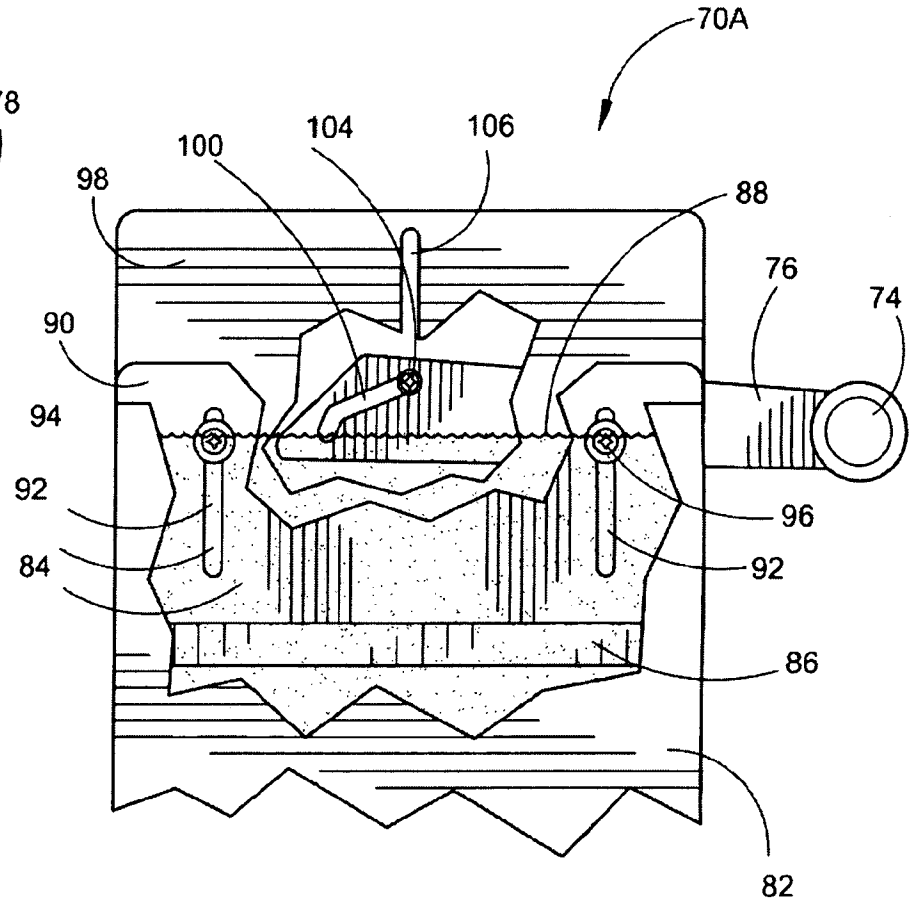
FIG. 7 depicts a front view of the sanitizing chamber with several surfaces cut away illustrating the knife rack in the down position and the up and down mechanism.

FIG. 7 depicts a front view of the knife locker and sanitizing system 10 with several surfaces cut away illustrating the implement rack 72 in the down position and sanitizing chamber back wall 98 cut away to revel the secondary guide slot 100 in the lever arm 76. The secondary guide pin is in the lowest position within the third guide slot 106. With the implement rack base plate 86 below the sanitizing liquid surface 88, the blades and handles of the knives 44 along with any other food processing implements will be fully immersed in the sanitizing liquid 84.

Figure 8:
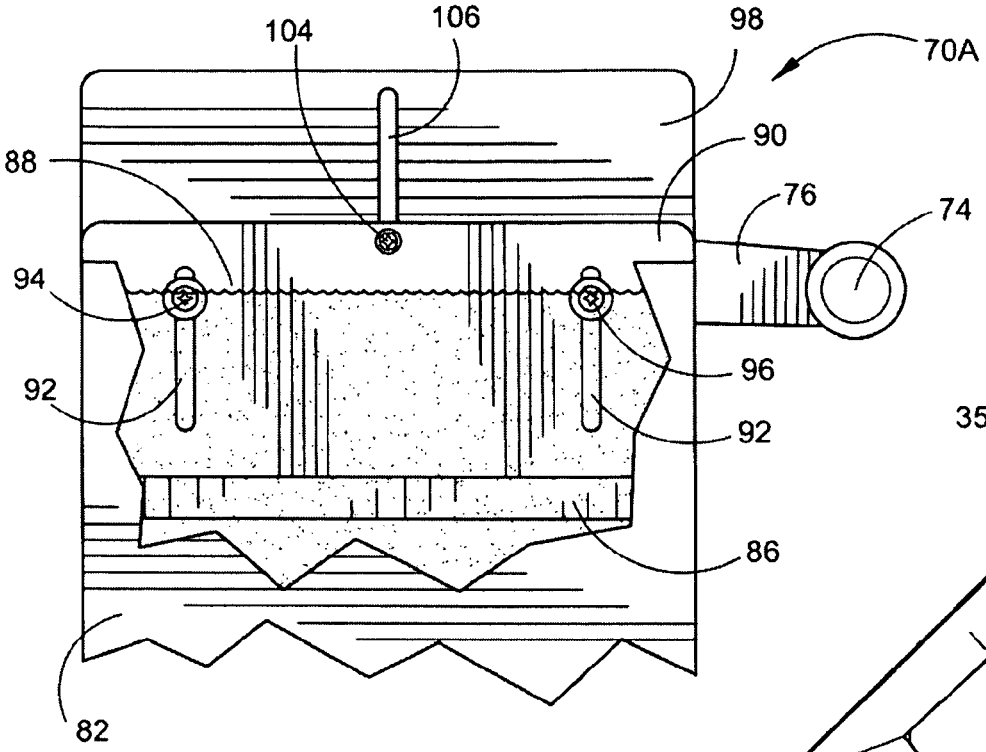
FIG. 8 depicts a front view of the knife locker and sanitizing system with the front panel cut away illustrating the guide slots for the up and down movement of the knife rack.

FIG. 8 depicts a front view of the knife locker and sanitizing system 10 with the front panel cut away illustrating the guide slots 92 for the up and down movement of the implement rack 72 with the secondary guide pin 104 is in the lowest position of the third guide slot 106. The lowest part of the guide slot 106 is above the sanitizing liquid surface 88 insuring that the sanitizing liquid 84 does not leek out through the sanitizing chamber back panel 96.

Figure 9:
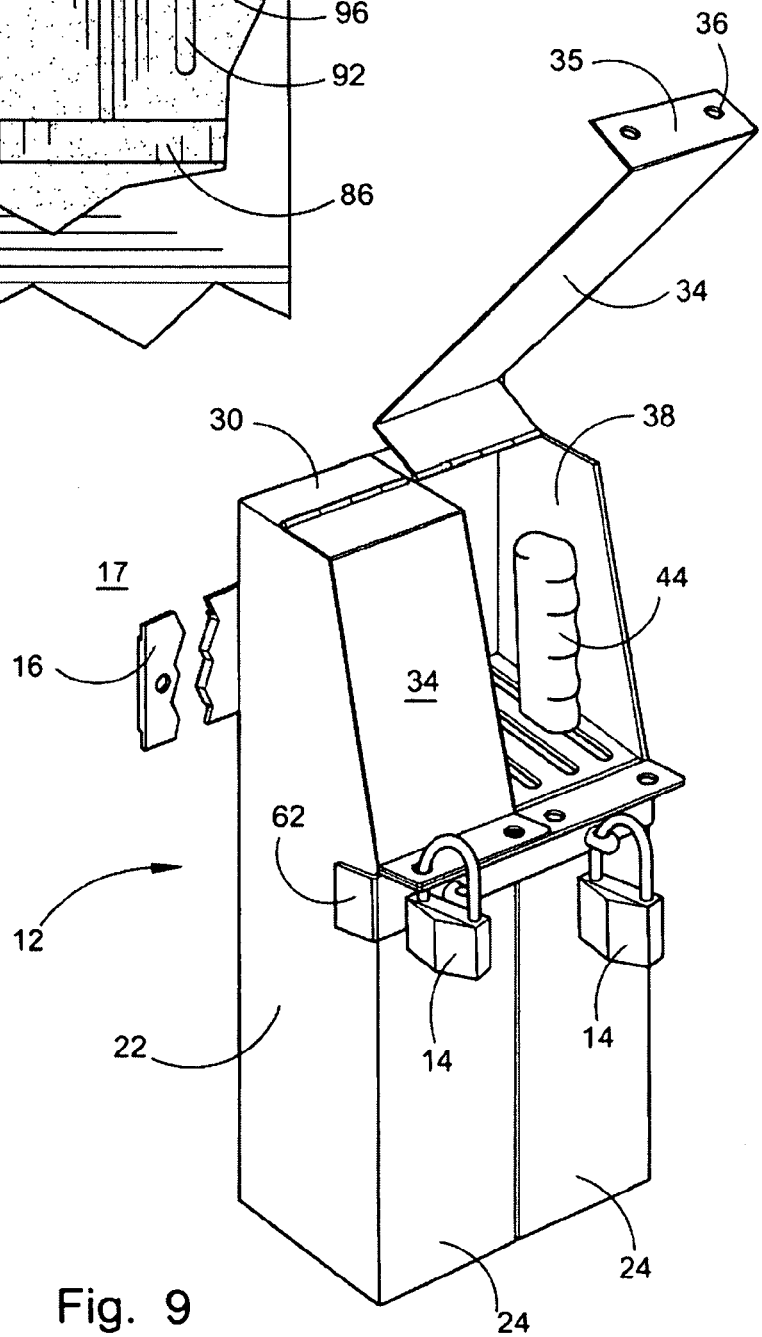
FIG. 9 depicts a perspective view of the knife locker used separately from the sanitizing chamber.

FIG. 9 depicts a perspective view of the knife locker 12 used separately from the sanitizing chamber 70A. This figure also illustrates that the present invention is scalable, that is, as many of the knife locker units 12 that are needed may be positioned and mounted on the system mounting bar 16, which could be as long as is needed to accommodate the number of units required for the cutting facility (restaurant, meat processing plant, etc.) depending on the number of knives in use. The system could also be mounted on a standard shelf.

Figure 10:
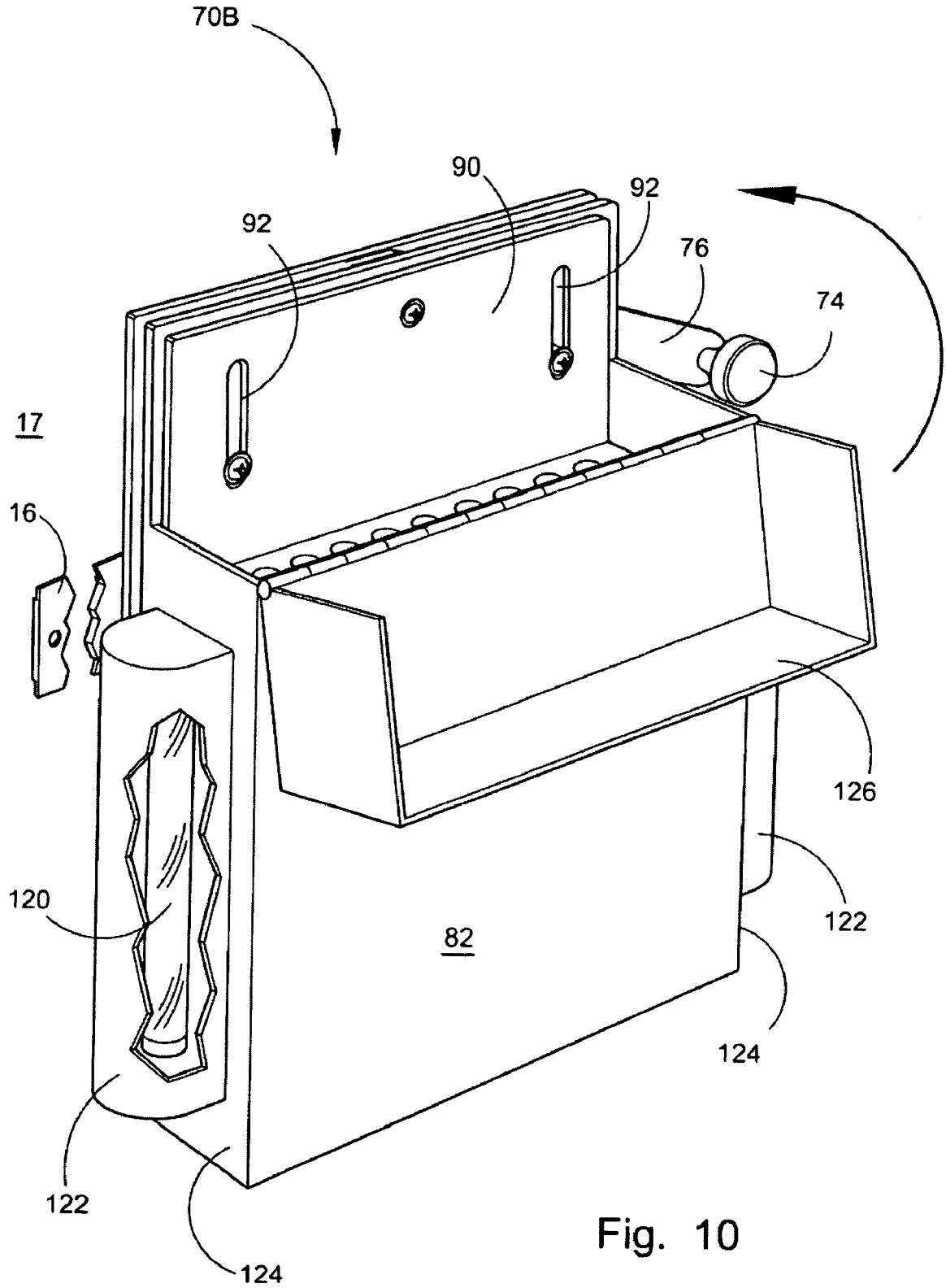
FIG. 10 depicts a perspective view an alternate embodiment of the sanitizing chamber using ultra violet lights with a light tight cover lid.

FIG. 10 depicts a perspective view an alternate embodiment of the sanitizing chamber 70B using ultra violet lights 120 housed in the containment areas 122 on the sanitizing chamber side panels 124 with a sanitizing chamber light tight cover lid 126 that will automatically turn on the ultraviolet lights 120 when the cover lid 126 is closed. It should be noted that with the present invention, not only the knife blades are exposed to the ultraviolet light for the purpose of disinfecting same, but also the knife handles are exposed to the disinfecting ultraviolet light, to add the capability of disinfecting the knife handles as well as the knife blades. This is an important feature, because during many food preparation operations or meat processing operations, the knife handles come into contact with the food being prepared, or the meat being processed. Therefore, it is vital to clean and disinfect the handles of the knives as well as the knife blades to keep the threat of contamination under strict control.

The knife locker and sanitizing system 10 is shown in the drawings and described in detail herein disclose arrangements of elements of particular construction and configuration for illustrating preferred embodiments of structure and method of operation of the present disclosure. It is to be understood, however, that elements of different construction and configuration and other arrangements thereof, other than those illustrated and described may be employed for providing a knife locker and sanitizing system 10 in accordance with the spirit of this application. Changes, alternations and modifications as would occur to those skilled in the art are considered to be within the scope of this application, as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the knife locker and sanitizing system of the application, which is measured by the claims, nor is it intended to be limiting as to the scope of the design in any way.

I claim:

1. A scalable wall mountable and securable combination lockable knife storage locker and lockable sanitizing chamber system comprising:

(a) one or more knife locker housing units having a top section, wherein a knife locker locking flange is moveably attached to said knife locker housing unit top section thereby enabling each individual knife locker housing unit to be separately locked using a conventional padlock, or left unlocked as required for operations, and further wherein said knife locker locking flange includes a locking bar assembly configured to lock and unlock individual knife locker housing units individually as well as lock and unlock multiple knife locker housing units simultaneously:

(b) one or more sanitizing chamber housing units having a top section wherein a sanitizing chamber locking flange is moveably attached to said sanitizing chamber housing unit top section, thereby enabling each individual sanitizing chamber housing unit to be separately locked using a conventional padlock, or left unlocked as required for operations, and wherein said sanitizing chamber housing unit includes an implement rack therein, including a plurality of implement accepting slots in said implement rack;

(c) further wherein said sanitizing chamber housing units include a hand operated agitation lever incorporated therein, for the purpose of agitating knives and implements to enhance the cleaning and sanitizing action of the system, and to lower the entire knife and implement, including the handle, to enable the entire implement to be sanitized; and (d) one or more system mounting bars whereby one or more of said knife locker housing units and one or more of said sanitizing chamber housing units are slidably and securely mounted thereon.

2. A scalable wall mountable and securable combination lockable knife storage locker and lockable sanitizing chamber system, according to claim 1, wherein said implement rack includes a plurality of implement accepting slots capable of accepting both knives and cooking implements to be stored and sanitized as required.

3. A scalable wall mountable and securable combination lockable knife storage locker and lockable sanitizing chamber system, according to claim 1, wherein said sanitizing chamber housing units contain sanitizing liquid for cleaning and sanitizing knives and implements, and further wherein said sanitizing liquid is held at room temperature.

4. A scalable wall mountable and securable combination lockable knife storage locker and lockable sanitizing chamber system, according to claim 1, wherein said sanitizing housing units include lids and contain a UV light source for disinfecting and sanitizing knives and implements.

5. A scalable wall mountable and securable combination lockable knife storage locker and lockable sanitizing chamber system, according to claim 4, wherein said UV light source is connected to an on-off switch incorporated into the lid of said sanitizing chamber housing, such that when the lid is up the UV light is off and when the lid is down the UV light is on.

6. A scalable wall mountable and securable combination lockable knife storage locker and lockable sanitizing chamber system, according to claim 1, wherein said a system mounting bar whereby one or more of said knife locker housing units and one or more of said sanitizing chamber housing units are mounted thereon, is mounted on a wall allowing multiple combinations and numbers of locker units and sanitizing units to be mounted depending upon the requirements of the operation.

7. A scalable wall mountable and securable combination lockable knife storage locker and lockable sanitizing chamber system, according to claim 1, wherein said knife locker housing units and one or more of said sanitizing chamber housing units are mounted on a shelf.

* * * * *